US007055273B2

(12) United States Patent
Roshkoff

(10) Patent No.: US 7,055,273 B2
(45) Date of Patent: Jun. 6, 2006

(54) REMOVABLE LABEL AND INCENTIVE ITEM TO FACILITATE COLLECTING CONSUMER DATA

(75) Inventor: Kenneth S. Roshkoff, Villanova, PA (US)

(73) Assignee: Attitude Measurement Corporation, Southampton, PA (US)

( * ) Notice: Subject to any disclaimer, the term of this patent is extended or adjusted under 35 U.S.C. 154(b) by 339 days.

(21) Appl. No.: 10/188,655

(22) Filed: Jul. 2, 2002

(65) Prior Publication Data

US 2003/0070338 A1 Apr. 17, 2003

Related U.S. Application Data

(60) Provisional application No. 60/329,065, filed on Oct. 12, 2001.

(51) Int. Cl.
*G09F 3/04* (2006.01)
*G09F 3/10* (2006.01)

(52) U.S. Cl. ..... 40/638; 40/594; 40/630

(58) Field of Classification Search ..... 40/638, 40/630, 594; 428/40, 40.1, 192, 198, 194
See application file for complete search history.

(56) References Cited

U.S. PATENT DOCUMENTS

| | | | | |
|---|---|---|---|---|
| 1,273,105 A | | 7/1918 | Van Dyke et al. | 40/130 |
| 2,616,612 A | | 11/1952 | Guttman | 229/92.8 |
| 3,250,385 A | | 5/1966 | Timms | 206/56 |
| 3,436,854 A | | 4/1969 | Wurzburg et al. | 40/10 |
| 3,525,470 A | | 8/1970 | Carrigan | 229/74 |
| 3,858,792 A | | 1/1975 | Volkert | 229/73 |
| 3,943,645 A | | 3/1976 | Viesturs | 40/10 |
| 4,103,821 A | | 8/1978 | Gartshore et al. | 229/74 |
| 4,405,157 A | | 9/1983 | Bennett | 283/58 |
| 4,559,727 A | | 12/1985 | Lewyt | 40/10 |
| 4,592,572 A | | 6/1986 | Instance | 218/2 |
| 4,621,837 A | | 11/1986 | Mack | 238/105 |
| 4,652,239 A | * | 3/1987 | Brimberg | 434/80 |
| 4,722,554 A | | 2/1988 | Pettit | 283/105 |
| 4,846,504 A | | 7/1989 | MacGregor et al. | 283/102 |
| 4,868,027 A | | 9/1989 | Hunkeler et al. | 428/42 |
| 4,900,604 A | * | 2/1990 | Martinez et al. | 428/79 |
| 4,991,878 A | * | 2/1991 | Cowan et al. | 283/81 |
| 5,024,014 A | * | 6/1991 | Swierczek | 40/310 |
| 5,127,676 A | | 7/1992 | Bockairo | 283/81 |
| 5,137,304 A | | 8/1992 | Silverschotz et al. | 283/100 |
| 5,162,138 A | * | 11/1992 | Caflisch et al. | 428/17 |
| 5,172,936 A | | 12/1992 | Sullivan et al. | 283/81 |
| 5,181,744 A | | 1/1993 | Betheil | 283/56 |
| 5,234,735 A | | 8/1993 | Baker et al. | 428/40 |

(Continued)

OTHER PUBLICATIONS

CCL Label, "Expandable Content Labels," brochure.

(Continued)

*Primary Examiner*—Cassandra Davis
(74) *Attorney, Agent, or Firm*—Drinker Biddle & Reath LLP

(57) ABSTRACT

A label and incentive item for collecting data in connection with consumer surveys is provided having a pre-approved incentive card with a base layer for attaching to a product package or release paper. The pre-approved incentive card has indicia printed on its outer side. An outer layer is provided covering at least a portion of the pre-approved incentive card. The outer layer may reproduce indicia on a product package obscured by the label and incentive item. The outer layer may have indicia imprinted on its outer side or inner side, for use as a coupon or other valuable purchasing incentive.

7 Claims, 12 Drawing Sheets

U.S. PATENT DOCUMENTS

| | | | | | |
|---|---|---|---|---|---|
| 5,263,743 | A | | 11/1993 | Jones | 283/81 |
| 5,308,119 | A | | 5/1994 | Roshkoff | 283/58 |
| 5,403,636 | A | | 4/1995 | Crum | 428/40 |
| 5,439,721 | A | | 8/1995 | Pedroli et al. | 428/40 |
| 5,489,123 | A | | 2/1996 | Roshkoff | 283/81 |
| 5,501,491 | A | | 3/1996 | Thompson | 283/70 |
| 5,531,482 | A | | 7/1996 | Blank | 283/67 |
| 5,571,358 | A | * | 11/1996 | Napier et al. | 156/227 |
| 5,628,530 | A | | 5/1997 | Thronton | 283/67 |
| 5,727,819 | A | | 3/1998 | Grosskopf et al. | 283/81 |
| 5,738,382 | A | | 4/1998 | Grosskopf et al. | 283/81 |
| 5,743,568 | A | | 4/1998 | Smith, III | 283/65 |
| 5,766,716 | A | | 6/1998 | Barry | 428/40.1 |
| 5,804,271 | A | | 9/1998 | Barry | 428/40.1 |
| 5,829,507 | A | * | 11/1998 | Pawlowski | 160/368.1 |
| 5,865,470 | A | | 2/1999 | Thompson | 283/70 |
| 5,918,910 | A | | 7/1999 | Stillwagon et al. | 283/67 |
| 6,042,149 | A | | 3/2000 | Roshkoff | 283/67 |
| 6,582,546 | B1 | * | 6/2003 | Micek | 156/249 |

OTHER PUBLICATIONS

Endust Sweepstakes peel-off label.

Mid American, "Multi-Panel Construction Specifications" brochure.

* cited by examiner

REMOVABLE LABEL AND INCENTIVE ITEM TO FACILITATE COLLECTING CONSUMER DATA

RELATED APPLICATION

The present invention is related to and claims priority from U.S. Provisional Application entitled "REMOVABLE LABEL AND INCENTIVE ITEM TO FACILITATE COLLECTING CONSUMER DATA", filed Oct. 12, 2001, Ser. No. 60/329,065, which is incorporated herein by reference in its entirety.

FIELD OF THE INVENTION

This invention relates to label and incentive item to be placed on a product package at its point of purchase. An incentive item is provided having a removable label thereon.

BACKGROUND

Incentive items to entice a consumer to purchase a product have been used for many years. Packaging labels which include materials of value or interest to consumers are also known in the art. Typically, such materials include coupons, mail-in rebates, sweepstakes entry forms, product literature or related product information. Such materials are typically delivered by bulky multi-panel labels, expanded content labels or expanded content labels affixed to a product package.

Coupons that peel off of a package for immediate redemption are also known in the art. Such coupons entice consumers to make an immediate purchase of the product in order to save money. Such coupons are not used to collect consumer information or demographic information for the purposes of marketing.

However, there is more to marketing than simply enticing a purchaser by offering free incentive items. Retailers and manufacturers seek information from consumers about the products consumers buy, the motivation behind consumer purchases, and the reasons consumers like or dislike certain products, as a way of improving a product or its marketing methods. Such information is typically obtained through surveys. In some cases, a survey is done by personally interviewing consumers about their purchases and preferences. This type of survey is usually done in-person at a retail outlet, or via telephone or internet. To be effective, the interviews must be done by experienced survey interviewers. Of course, personal surveys of this type are very expensive to conduct.

To cut costs, manufacturers and retailers have resorted to the use of sweepstakes entry forms or rebate coupons to elicit survey data from consumers once a purchase is made. This type of survey is less expensive than one which requires personal interviews, but nonetheless has drawbacks of its own. This type of survey is inefficient due to the historically low redemption rate, typically less than ten percent, of such forms or coupons.

Moreover, for consumer surveys to produce meaningful responses from consumers, the survey itself must not distort the responses. Deliberate purchasing enticements skew the survey data results. A company that wishes to understand the profile of its customers prefers to discover who is purchasing its products, absent any deliberate enticement to do so. Therefore, it is usually desirable when attempting to collect survey results via product purchasing to obscure the incentive item attached to the product or product package, so that the precise nature of the incentive item cannot be ascertained until after the customer has made the purchase.

The ability to obtain questionnaire data from customers in a manner that both elicits a response without necessarily enticing a purchase and is also adaptable to the myriad types of container and products available in retail stores remains a challenge in the art.

Manufacturers and retailers may also seek to combine enticing consumers to purchase a product with collecting consumer data information through surveys. In that case, the portions of an incentive item may be visible on a product package. However, even where a customer can perceive that they may be getting something in addition to the product which they are purchasing, it is important to obscure the precise nature of the incentive item.

In addition, when obscuring the nature of the incentive item attached to the product or product package, a company must be mindful of whether the incentive item covers any important package information.

Moreover, companies often seek to instill product loyalty in consumers by offering consumers free promotional items, such as magnets. These magnets may be imprinted with a company's logo, providing continued advertising while the magnet is in use in a customer's home.

Accordingly, there is a need for a pre-approved incentive card delivery system that is adaptable to the myriad types of containers and products available in retail stores and that allows delivery of a pre-approved incentive card that requires a recipient to participate in a survey to redeem the incentive item in such a manner that both draws customer attention to the presence of the card within the label while not explicitly revealing its presence in a retail store.

Furthermore, there is a need for a label which can provide an incentive card in combination with necessary product labeling information even if the stick-on label covers up all or part of the product package's label.

There is also the need for a label and inventive item which is provided in combination for ease of use.

There is even further the need for a combination label and incentive item that can be manufactured in a cost effective manner.

There is yet further the need for a label and incentive item having an advertising mechanism a consumer can retain after the product package has been disposed of.

The present invention fills those needs.

SUMMARY OF THE INVENTION

The present invention is directed to a removable label and incentive item to facilitate collecting consumer data. The present invention provides a combination label and incentive item that will not obscure information on a product package covered by the label and incentive item, and is also provided in a convenient combination format.

In one embodiment, an incentive item is provided having a base layer with an adhesive on its inner side, which can be permanently affixed to the surface of a product package. The base layer has an outer side to which an incentive item may be removably attached. The incentive item has a outer side to which an outer layer is removably attached. The outer layer covers at least a portion of the incentive item. The outer layer can reproduce labeling information obscured when the incentive item is attached to a product package.

In another embodiment, an incentive item is removably attached to a product package by a cover portion. The cover portion covers at least a portion of the incentive item, but may also be sized to entirely cover the incentive item. The cover portion has an outer edge for directly contacting and attaching to a product package. The inner side of the cover portion has an adhesive thereon for removably attaching to the incentive item. The outer layer of the cover portion can reproduce labeling information obscured when the incentive item is attached to a product package.

In yet another embodiment of the present invention, an incentive item is provided having a scratch-off coating applied to the outer side of the incentive item. The scratch-off coating can reproduce labeling information obscured when the incentive item is attached to a product package.

In yet another embodiment of the present invention, an incentive item is provided with an intermediate layer and an outer layer. The intermediate layer is disposed between the incentive item and the outer layer. The outer layer is removably attached to the intermediate layer, and the outer layer may have indicia printed on its inner side and/or outer side.

In yet another embodiment of the present invention, an incentive item has a magnetic layer.

The present invention provides a convenient means for facilitating collection of consumer data, as well as increased advertising opportunities for manufacturers, and which can be manufactured at a reasonable cost.

DRAWINGS

FIG. 1 illustrates a perspective view of a preferred form of a label and incentive item in accordance with the invention before the label and incentive item is attached to a product or product package.

FIG. 2*a* shows a perspective view of the label and incentive item of FIG. 1 after the outer layer has been removed, and after the pre-approved incentive item has been separated from the base layer, showing the location of indicia on the inner side of the outer layer.

FIG. 2' shows a side view of the embodiment of the label and incentive item of FIG. 1.

FIG. 3 shows a perspective view of an alternate embodiment of the present invention wherein the outer layer attaches to the product package.

FIG. 3' shows a back view of the embodiment of the present invention shown in FIG. 3.

FIG. 3*a* shows a perspective view of an alternate embodiment of the present invention wherein the outer layer completely covers the pre-approved incentive card and attaches to the product package.

FIG. 3*a'* shows the back view of the embodiment shown in FIG. 3*a*.

FIG. 3*b* shows a perspective view of an alternate embodiment of the present invention wherein the outer layer is a strip covering the pre-approved incentive card and attaching to the product package.

FIG. 3*b'* shows the back view of the embodiment shown in FIG. 3*b*.

FIG. 4 shows a perspective view of an alternate embodiment of the present invention having a scratch-off coating.

FIG. 5*a* shows a perspective view of an alternate embodiment of the present invention wherein an intermediate layer is disposed between the outer layer and the pre-approved incentive card.

FIG. 5*b* shows a side view of the embodiment of the present invention shown in FIG. 5*a*.

Figure 7:
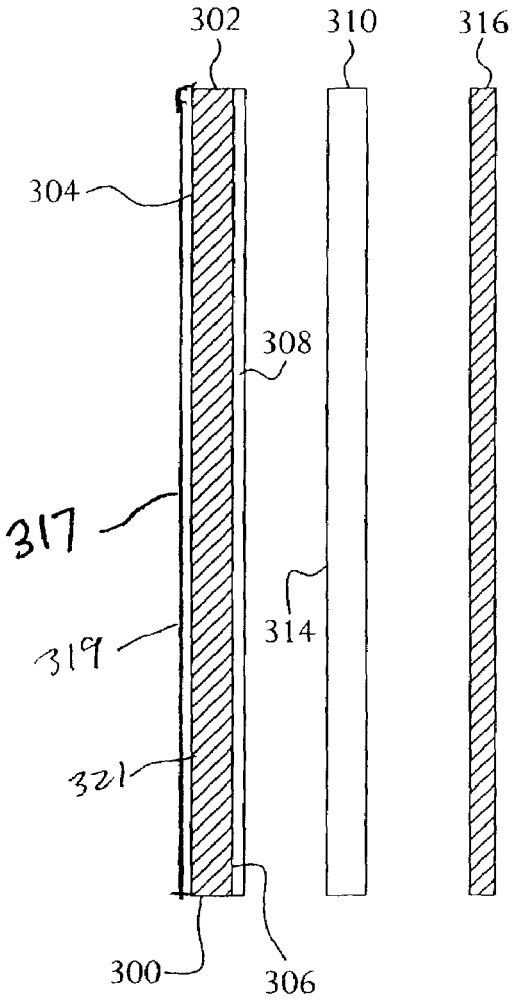
FIG. 7 shows a side view of an alternate embodiment of the present invention having a separable magnetic item.
Figure 7:
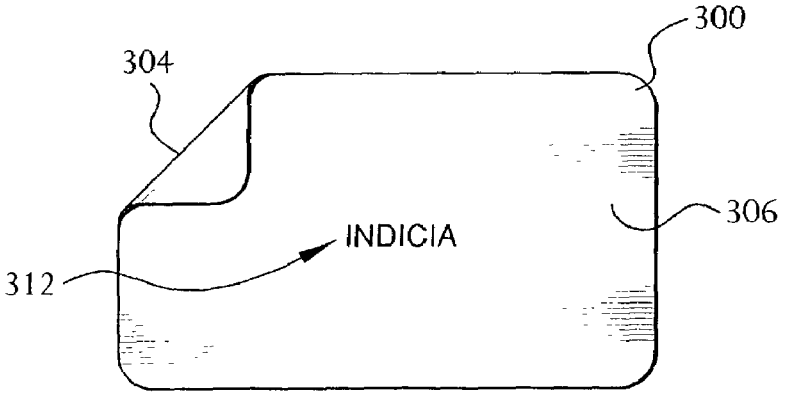

FIG. 7' shows a perspective view of the magnetic item of the embodiment shown in FIG. 7.

DETAILED DESCRIPTION OF THE INVENTION

While the invention is described herein in connection with preferred embodiments, it is understood that it is not intended to limit the invention to those embodiments. On the contrary, it is intended to cover all alternatives, modifications, and equivalents as may be included within the spirit and scope of the invention as defined by the appended claims.

The incentive item depicted herein is a "pre-approved incentive item" or "pre-approved incentive card." The terms "pre-approved incentive item" and "pre-approved incentive card" are used interchangeably, and are meant in a broad sense to include an article entitling the bearer to receive cash or a fixed amount of goods or services, wherein the incentive item must be activated before the bearer may redeem the value of the item. The incentive item may be activated by participating in an interview or survey. By way of illustration and not by way of limitation, an example of a pre-approved incentive card is a prepaid telephone calling card which entitles the bearer to free long distance telephone service for a period of time. It is contemplated as part of the invention that a pre-approved incentive card, once activated, could be used to purchase any product or service. Additional examples are debit cards that entitle the bearer to withdraw a predetermined amount of cash at an automated teller machine (ATM), or to purchase food, gasoline, etc., upon the completion of a survey. The survey may be conducted in person, telephonically, by mail, or via the internet.

The term "indicia" in this invention is meant to include any and all text, designs, advertising or graphics that may appear on a product package or label, or any surface of a pre-approved incentive card. By way of example and not by way of limitation, indicia on a product package could include nutritional information, Universal Product Code (UPC) symbols, logos, trademarks, elements of trade dress, copyrighted designs, coupon information, and any other labeling information. Indicia on a pre-approved incentive card could include information regarding a contest, coupon, debit card, advertising or any other information.

The term "product package" as used herein means any package or container. It is appreciated that a product package may be purchased or obtained in person, or may be received by mail. It is also appreciated that a product package may be received free of charge, such as by way of a sample of a product.

Figure 1:
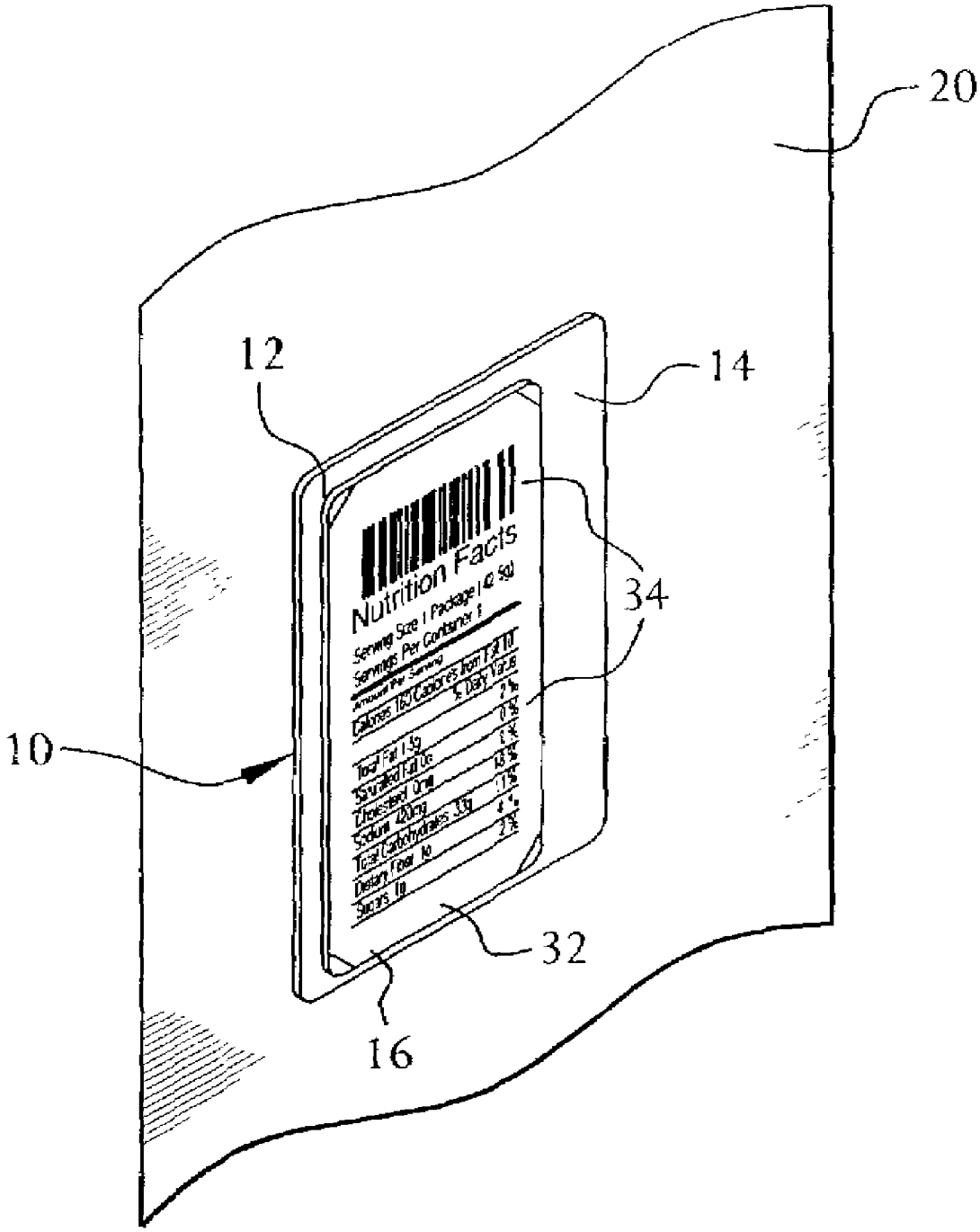
Figure 2:
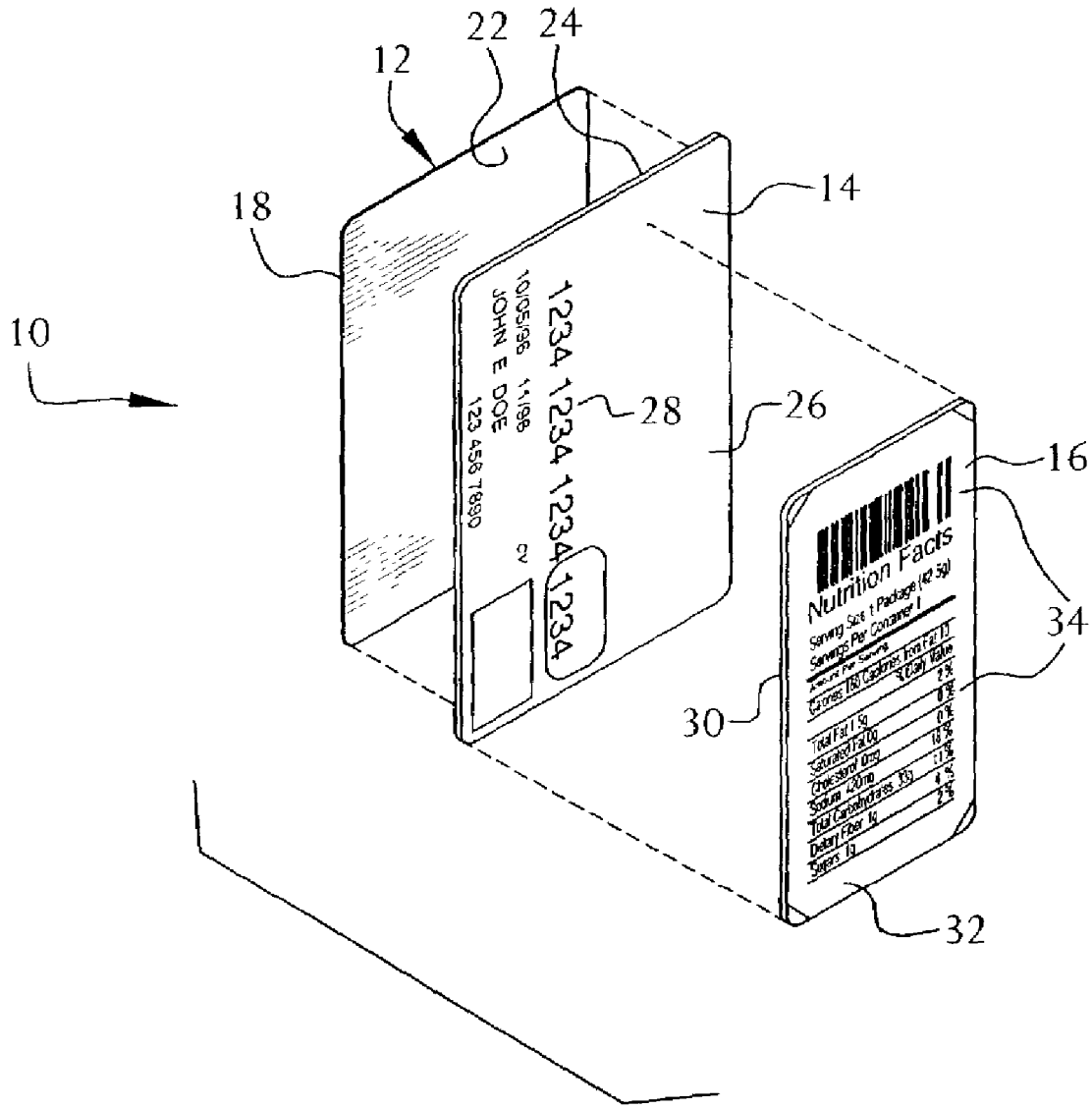
Figure 2:
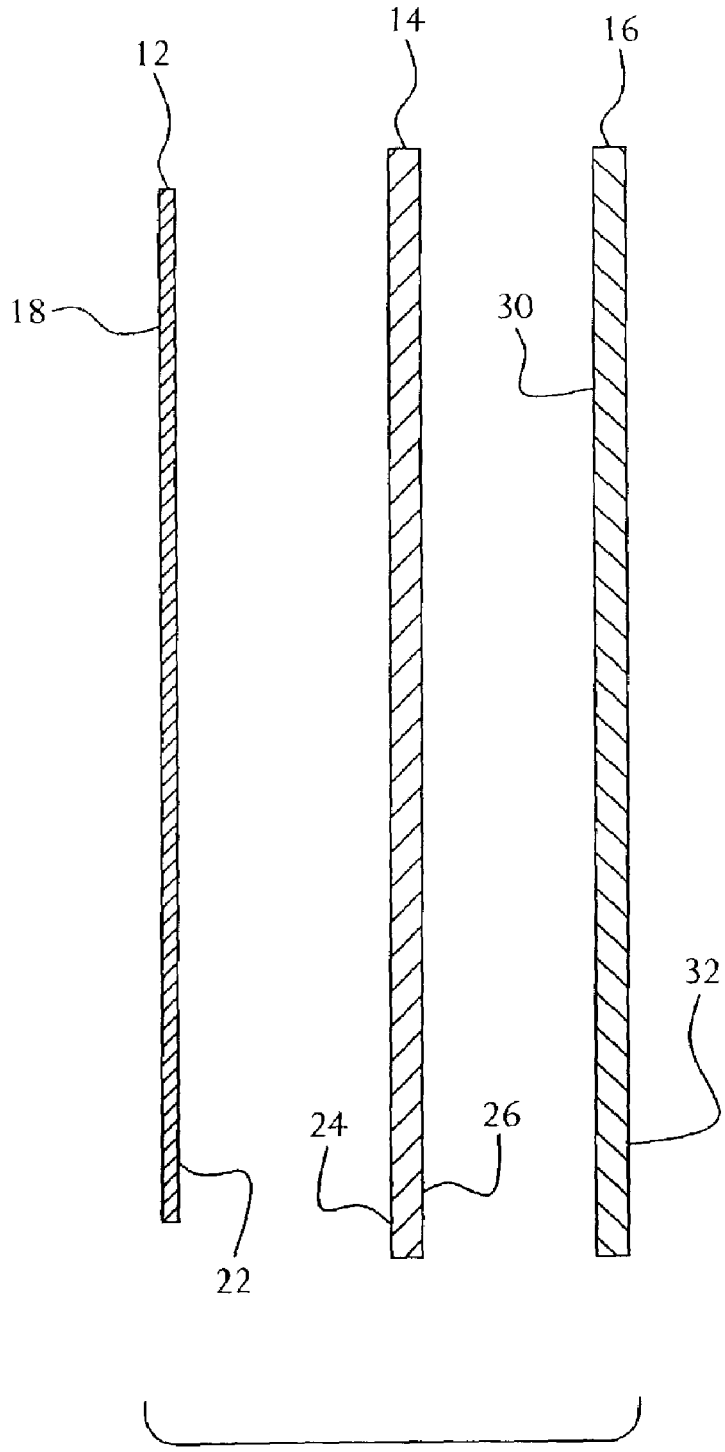
Figure 2A:
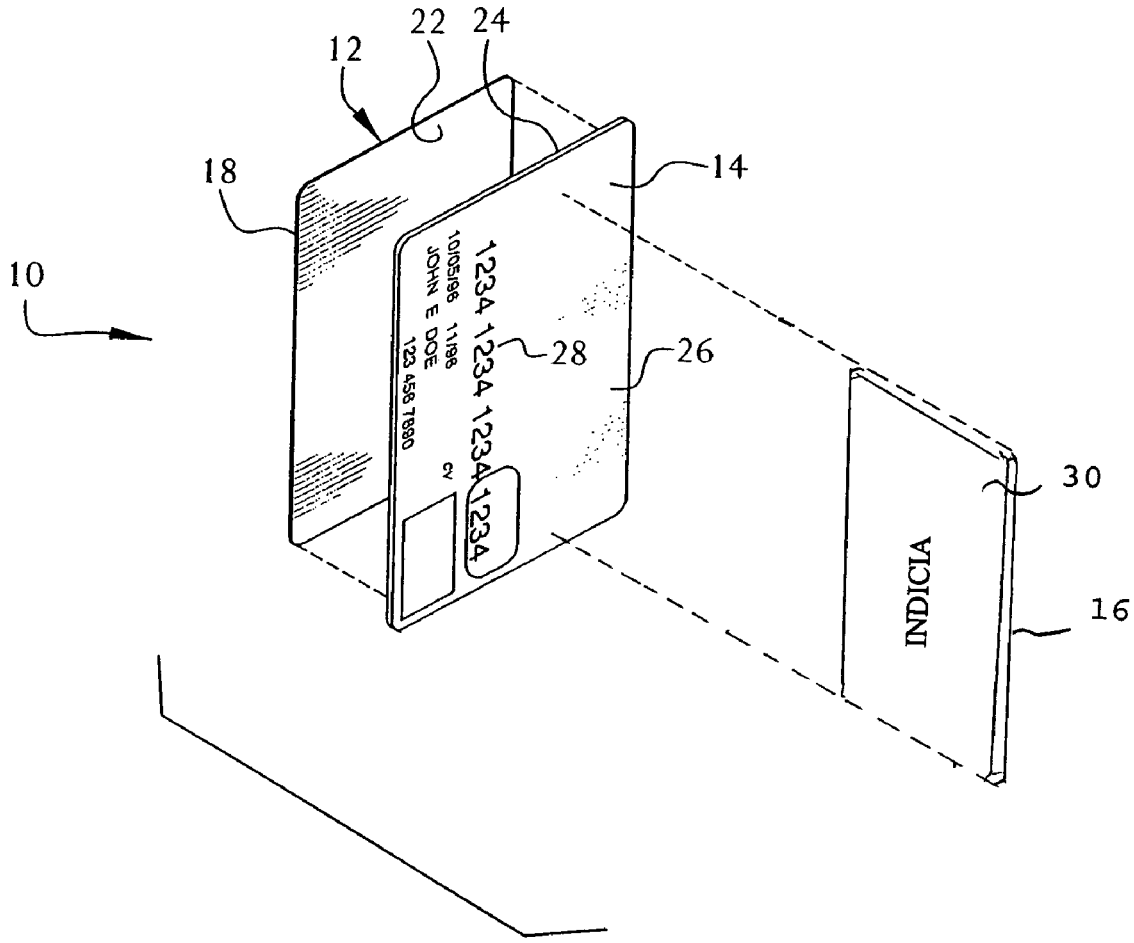

FIGS. 1 and 2 show a perspective view of a preferred embodiment of a removable label and incentive item of the present invention. A side view of the preferred embodiment is shown in FIG. 2'. In the preferred embodiment, the removable label and incentive item 10 comprises a base layer 12, a pre-approved incentive card 14, and an outer layer 16. When joined together, the discrete parts form a single, unitary structure which can be affixed to a product package.

As shown in FIGS. 1, 2 and 2', adhesion to a container is obtained by a suitable adhesive on the inner side 18 of the base layer 12, such as a pressure sensitive adhesive, as is well-known in the art. Before application of the incentive item 10 to a container, the incentive item 10 in the form shown in FIGS. 1 and 2 may be stored on wax-coated or plastic-coated release paper 20. The incentive item 10 can then be easily peeled off-the release paper 20, exposing the pressure sensitive adhesive coating at least a portion of the inner side 24 of the pre-approved incentive card 14. Since the adhesive of the base layer 12 does not form any part of the invention and is well-known in the art, no further description is needed.

Base layer 12 is clear, semi-clear, translucent, or opaque, according to the specific needs of the user. However, in the preferred embodiment, the base layer 12 is clear or semi-clear, so that any text, graphics, indicia or labeling information printed on the container can be viewed through the base layer once the pre-approved incentive card 14 is removed. In addition, indicia can be imprinted on the base layer itself. It is appreciated that any adhesive, such a the base layer described in connection with some of the embodiments shown herein, can be of any suitable size capable of attaching the materials discussed herein. For example, a drop of glue, or "glue dot," would be considered within the scope of the invention.

As shown in FIG. 2, the base layer 12 has an outer side 22 opposite the inner side 18, for removably attaching the base layer 12 to the inner side 24 of the pre-approved incentive card 14. The outer side 22 of the base layer 12 comprises a dry-release adhesive, which acts to removably hold the pre-approved incentive card 14 to the base layer 12. Dry-release adhesives are well-known in the art. The dry-release adhesive is chosen so that the adhesive will not leave residue on the inner side 24 of the pre-approved incentive card 14 once the pre-approved incentive card 14 is removed from the base layer 12. When a dry-release adhesive is used, once the pre-approved incentive card 14 is removed from the dry-release adhesive on the outer side 22 of the base layer 12, the dry-release adhesive is no longer capable of sticking to the pre-approved incentive card. A suitable adhesive other than a dry-release adhesive can also be used on the outer side 22 of the base layer 12.

As shown in FIGS. 1 and 2, an outer layer 16 is provided, and is sized to cover at least a portion of the outer side 26 of the pre-approved incentive card 14. It is expected that the pre-approved incentive card 14 will have text, graphics, printing, or other indicia 28 imprinted on an outer side 26 of the pre-approved incentive card 14. The outer layer 16 is intended to cover at least some of the indicia 28 prior to the purchase or receipt of the product package. Thus, the outer layer 16 is sized to obscure that portion of the pre-approved incentive card 14 to be covered until the container is purchased or received. It is appreciated that the outer layer can be of any size necessary to cover the indicia provided on the pre-approved incentive card 14, and may also be sized to completely cover the pre-approved incentive card 14.

An adhesive is provided on the inner side 30 of the outer layer 16. The adhesive is designed so that once the outer layer 16 is separated from the pre-approved incentive card 14, the adhesive does not leave a residue on the pre-approved incentive card 14. The outer layer 16 is designed so that it can be removed by a consumer or any type of potential survey respondent, exposing the portion of the pre-approved incentive card 14 that is covered by the outer layer 16. Where the present invention is used for the purpose of eliciting responses to a survey, the outer layer 16 is removed only after the product is purchased, or after a potential respondent or survey participant receives a free sample of the product.

The outer layer 16 can also be formed from a flexible plastic material that is capable of adhering to the outer side 26 of the pre-approved incentive card 14 by electrostatic attraction. Such a label is known in the art as a "static cling" label. The use of a static cling label eliminates the need for the adhesive on the inner side 30 of the outer layer 16, and allows indicia to be imprinted on the inner side 30 of the outer layer 16.

The label and incentive item arrangement of the present invention can be provided with a tamper-resistant component, so that store personnel can detect whether the pre-approved incentive card has been removed from the product package prior to purchase. The base layer 12 can be imprinted with text, graphic matter, or other indicia indicating to a person viewing the product package that the pre-approved incentive card has been removed. The printed text, graphic matter or other indicia can be printed in translucent printing, or can be positioned so that it will not obscure the underlying product package labeling, which will be visible through the clear or translucent base layer 12.

The outer layer 16 has an outer side 32 which is visible to a consumer when the incentive item 10 of the present invention is attached to the surface of a package. The outer side 32 is capable of having graphics, printing or other indicia imprinted thereon, so that the package labeling information which is obscured by the label and incentive item 10 can be duplicated on the outer side 32 of the outer layer 16. By way of example, assume that the incentive item 10 would obscure the nutritional information 34 required on food product packaging, or would obscure the UPC bar code and nutritional labeling information. In such cases, the outer side 32 of the outer layer 16 would reproduce the bar code and nutritional information 34 or UPC labeling, as shown in FIGS. 1 and 2, as required.

After a consumer removes the outer layer 16, and removes the pre-approved incentive card 14, the base layer 12 remains on the product package. It is understood that if text, graphics, labeling or other indicia on the product package is covered by the base layer 12, the base layer 12 can be clear or translucent so that the label information can be seen through the base layer 12. The base layer 12 could also be opaque if necessary.

In addition, other indicia can be printed on the outer side 32 of the outer layer 16, such as promotional information alerting the consumer to the presence of the pre-approved incentive card 14 attached to the package. Preferably, however, the graphics printed on the outer side 32 of the outer layer 16 are designed to blend with the underlying product packaging, thereby concealing the precise nature of the pre-approved incentive card 14, so that the availability of the pre-approved incentive card 14 does not influence a consumer's selection of the product.

Figure 3:
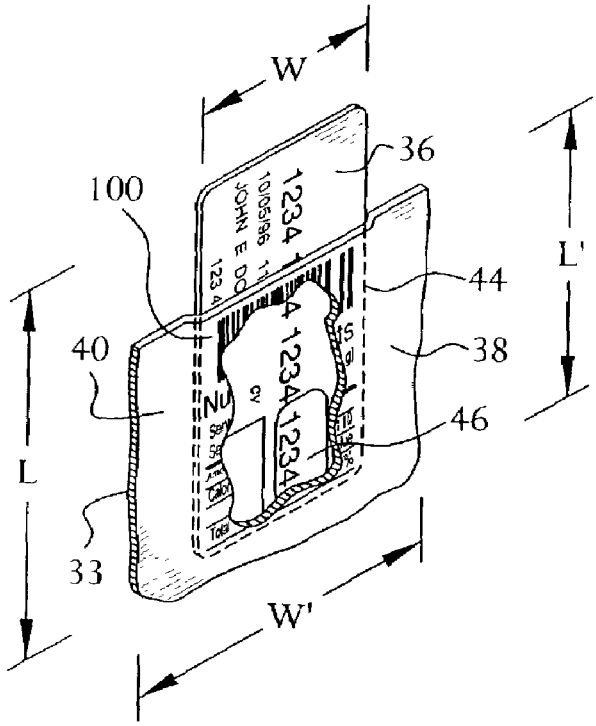
Figure 3:
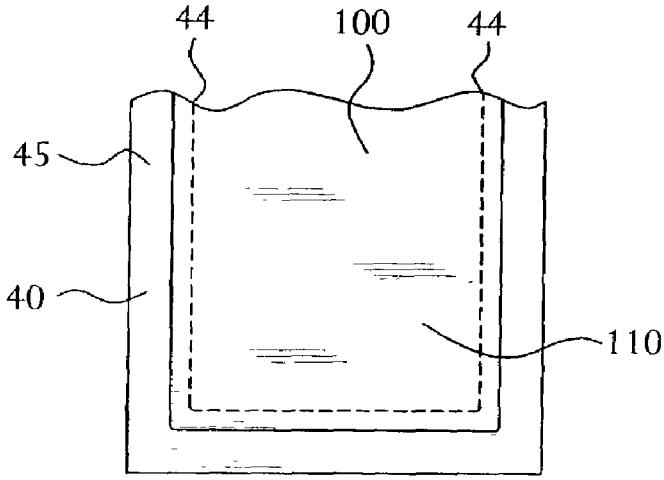

In another embodiment of the present invention, shown in FIG. 3, the pre-approved incentive card 36 is not attached directly to the product package. In this embodiment, the outer layer 38 has a cover portion 100 which covers at least a portion of the pre-approved incentive card 36, and has an outer edge 40 capable of directly contacting and attaching to a product package. In the embodiment shown in FIGS. 3 and 3', the outer layer 38 and outer edge 40 have a width W' greater than the width W of the pre-approved incentive card 36, and length L' extending along at least a portion of the length L of the pre-approved incentive card 36. The cover portion 100 can be any size to cover any indicia printed on the pre-approved incentive card 36.

At least a portion of the inner side 110 of the cover portion 100 contacting the pre-approved incentive card 36 can have an adhesive thereon, so that the pre-approved incentive card 36 is removably attached to the inner side 110 of the cover portion 100 when the outer layer 38 is removed from a product package. The adhesive used on the inner side 110 of the cover portion 100 may be chosen from the type of adhesive that will not leave a residue on the pre-approved incentive card 36 once the cover portion 100 is separated from the pre-approved incentive card 36.

As shown in more detail in FIG. 3', the inner side 45 of the outer edge 40 has an adhesive thereon for attaching the outer layer 38 to a product package. The outer layer 38, thus affixed to the product package, will hold the pre-approved incentive card 36 in place. The adhesive is affixed to the inner side 45 of the outer edge 40 of the outer layer 38, rather than directly to the pre-approved incentive card 36. The adhesive can be any suitable adhesive, as is known in the art. When the outer layer 38 is removed from the product package, the pre-approved incentive card 36 adheres to the inner side 110 of the cover portion 100, as described above.

The outer layer 38 can be provided with perforations 44 to allow the pre-approved incentive card 36 and cover portion 100 to be removed from the product package, without removing the outer edge 40 from the product package.

As shown in FIG. 3, the outer layer 38 can be imprinted with any indicia duplicating that part of the product package label obscured by the outer layer 38 and pre-approved incentive card 36.

Figure 3A:
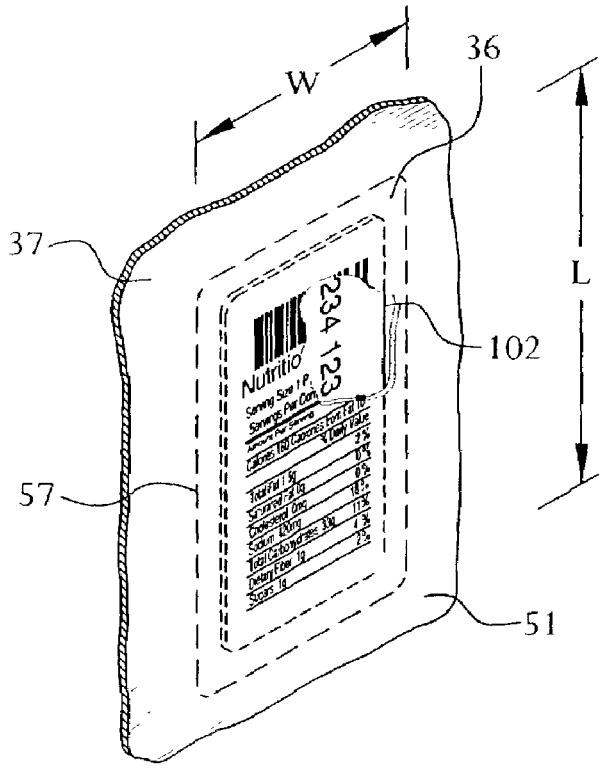
Figure 3A:
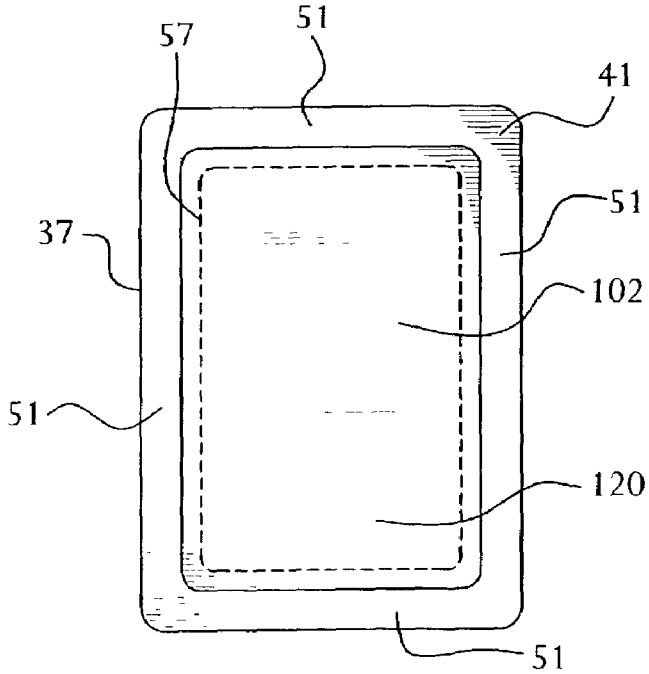

It is contemplated that the outer layer can also be provided with a cover portion completely covering the pre-approved incentive card on all edges, ends, or sides. FIGS. 3*a* and 3*a'* show an embodiment wherein the outer edge 51 of the outer layer 37 extends beyond both the width W and the length L of the pre-approved incentive card 36, and the cover portion 102 entirely covers the pre-approved incentive card 36 completely. In this embodiment, a customer would not appreciate the precise nature of the pre-approved incentive card 36, which would be completely obscured by the outer layer 37. FIG. 3*a'* shows a back view of the inner side 41 of the outer edges 51 and outer layer 37 of the embodiment shown in FIG. 3*a*.

The inner side 120 of the cover portion 102 can have an adhesive thereon, so that the pre-approved incentive card 36 is removably attached to the inner side 120 of the cover portion 102 when the outer layer 37 is removed from a product package. The adhesive used on the inner side 120 can be chosen to leave no residue on the pre-approved incentive card.

The outer layer 37 can be provided with perforations 57 to allow the pre-approved incentive card 36 and cover portion 120 to be removed from the product package, without removing the outer edge 51 from the product package.

As shown in FIGS. 3*a* and 3*a'*, the outer layer 37 can be imprinted with any indicia duplicating that part of the product package label obscured by the outer layer 37 and pre-approved incentive card 36.

Figure 3B:
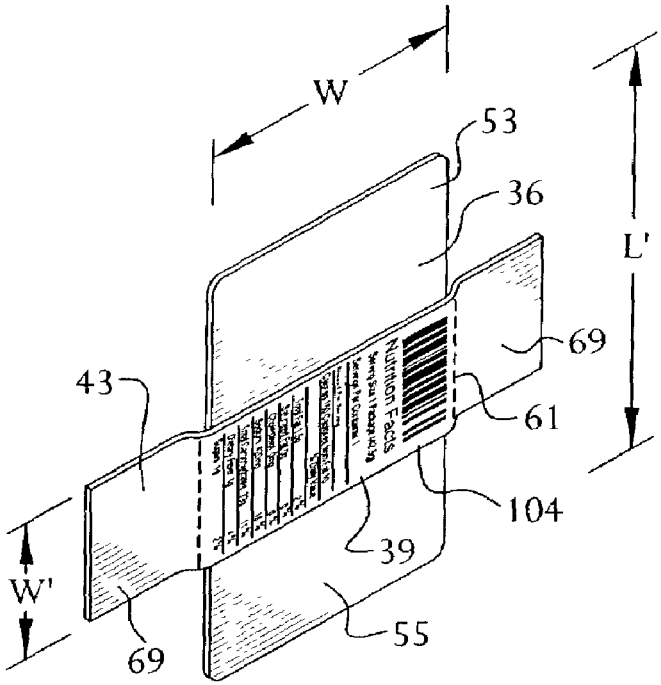
Figure 3B:
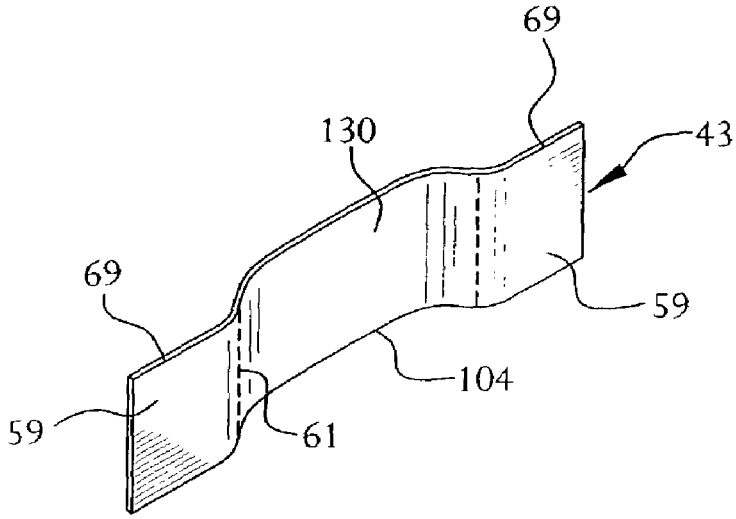

FIGS. 3*b* and 3*b'* show another alternate embodiment, wherein the outer layer 43 is provided as a band 39 which extends across and beyond the width W of the pre-approved incentive card 36. The cover portion 104 covers only a portion of the pre-approved incentive card 36. In this embodiment, the upper 53 and lower 55 portions of the pre-approved incentive card 36 are not covered by the cover portion 104. In the embodiment shown in FIGS. 3*b* and 3*b'*, the width W' of the outer layer 43 can be sized to match the length L of the pre-approved incentive card 36, if a larger portion of the pre-approved incentive card 36 is to be covered.

End portions 69 form outer edges of the outer layer 43. The inner side 59 of the end portions 69 has an adhesive thereon for attaching the outer layer 43 to a product package. The outer layer 43, thus affixed to the product package, will hold the pre-approved incentive card 36 in place. The adhesive is affixed to the inner side 59 of the end portions 69 of the outer layer 43, rather than directly to the pre-approved incentive card 36. The adhesive can be any suitable adhesive known in the art, either for removably attaching the outer layer 43 to the product package or for providing a more permanent attachment.

As shown in FIG. 3*b'*, the inner side 130 of the cover portion 104 can have an adhesive thereon, so that the pre-approved incentive card 36 is removably attached to the inner side 130 of the cover portion 104 when the outer layer 43 is removed from a product package. When the outer layer 43 is removed from the product package, the pre-approved incentive card 36 adheres to the inner side 130 of the cover portion 104. The adhesive used on the inner side 130 can be chosen to leave no residue on the outer side of the pre-approved incentive card.

The outer layer 43 can be provided with perforations 61 to allow the pre-approved incentive card 36 and cover portion 104 to be removed from the product package, without removing the outer edge 43 from the product package.

As shown in FIGS. 3*b* and 3*b'*, the outer layer 43 can be imprinted with any indicia duplicating that part of the product package label obscured by the outer layer 43 and pre-approved incentive card 36.

Figure 4:
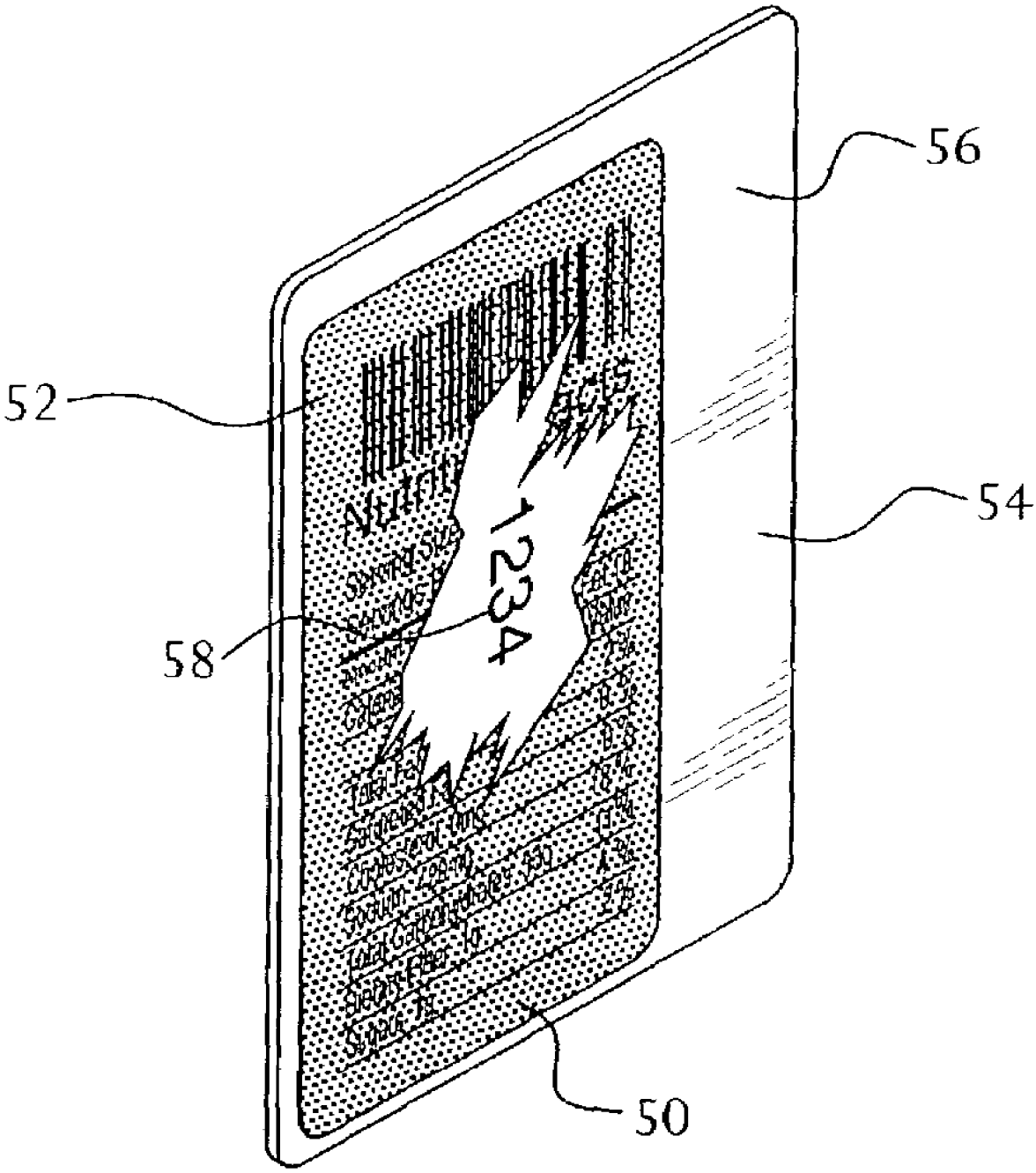

In yet another embodiment of the present invention, shown in FIG. 4, the outer layer 50 is provided as a scratch-off coating 52 applied to the outer side 54 of the pre-approved incentive card 56. It is appreciated that those skilled in the art are familiar with scratch-off coatings such as those used on, for example, instant-win lottery tickets. In this embodiment, the scratch-off coating 52 can be designed to include the copy or graphics on the product package obscured by affixation of the incentive item of the present invention. As shown in FIG. 4, part of the scratch-off coating 52 has been removed, revealing the indicia 58 printed on the outer side 54 of the underlying pre-approved incentive card 56. The pre-approved incentive card 56 is removably attached to a product package by means of a dry-release adhesive on its inner side, as described in detail above.

Figure 5A:
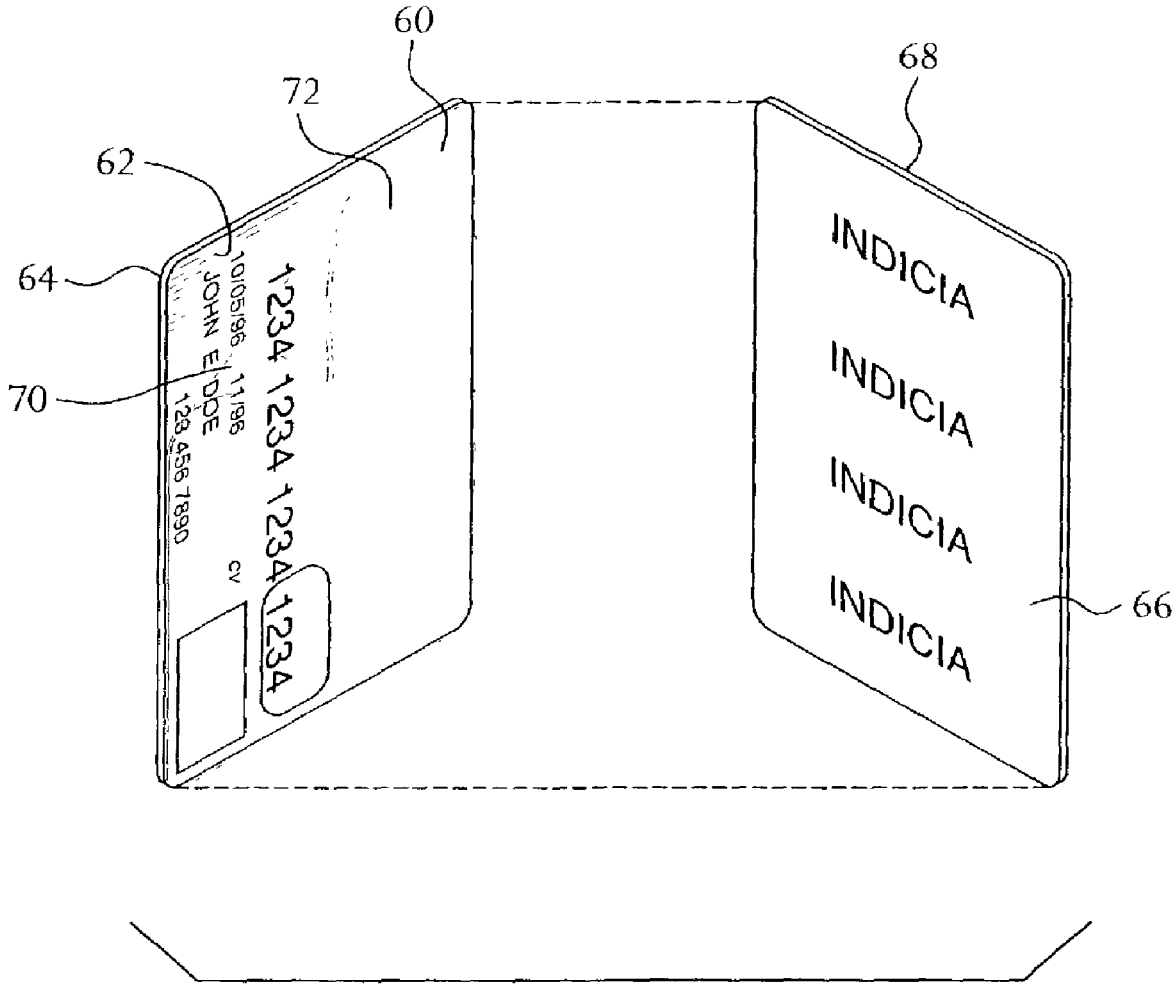
Figure 5B:
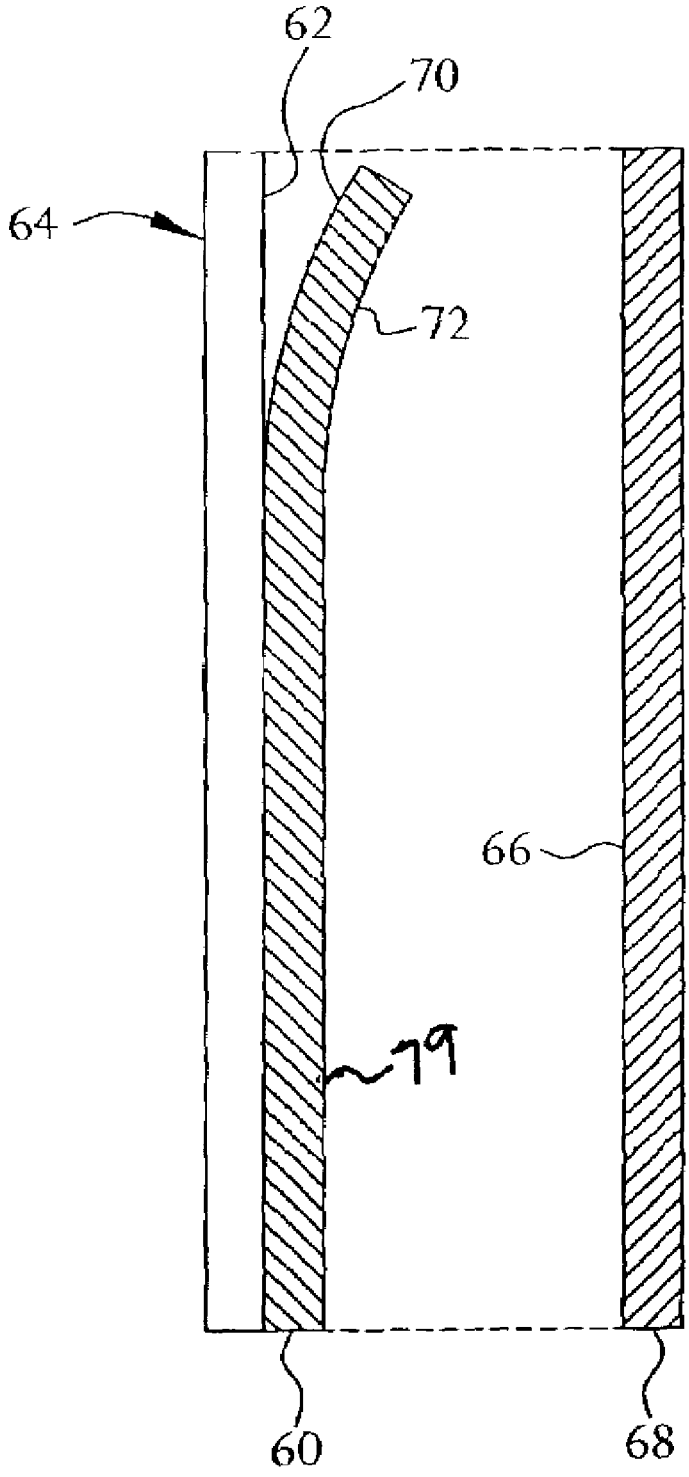

In yet another embodiment of the present invention, as shown in FIGS. 5*a* and 5*b*, an intermediate layer 60 is disposed between the outer side 62 of the pre-approved incentive card 64 and the inner side 66 of the outer layer 68. The intermediate layer 60 comprises an inner side 70 having a suitable adhesive thereon such as a pressure sensitive adhesive for securing the inner side 70 to the outer side 62 of the pre-approved incentive card 64. The outer side 72 of the intermediate layer 60 comprises a dry-release adhesive for removably attaching the intermediate layer 60 to the inner side 66 of the outer layer 68.

When the outer layer 68 of the embodiment shown in FIGS. 5*a* and 5*b* is placed on the pre-approved incentive card 64, the outer layer 68 will be secured by the intermediate layer 60. The outer layer 68 can then be removed from the intermediate layer 60, leaving the intermediate layer 60 attached to the pre-approved incentive card 64. Because a dry-release adhesive is used, the outer side 62 of the pre-approved incentive card 64 will not be sticky or tacky. Use of a dry-release adhesive should leave as little residue as possible on the inner side 66 of the outer layer 68.

The intermediate layer 60 can be clear, so that it will not obscure the printed or graphic material on the outer side 62 of the pre-approved incentive card 64 once the outer layer 68 is removed. It is appreciated that the intermediate layer 60 can also have an outer side 79 that reproduces the indicia on the product package obscured by the pre-approved incentive card 64.

Utilizing the arrangement shown in FIGS. 5*a* and 5*b*, the outer layer 68 can be imprintable on its inner side 66, having printing, graphics, or other indicia, visible to a consumer only after the outer layer 68 has been separated from the intermediate layer 60. Thus, the outer layer 68 can have, for example, a store coupon printed on its inner side 66, redeemable when the product to which the pre-approved incentive card 64 is attached is purchased. The inner side 66 of the outer layer 68 could also be imprinted with, for example, contest information, product information, a consumer survey questionnaire, instructions for participating in a consumer survey, or instructions concerning how to activate the pre-approved incentive card. It is contemplated that the inner side of the outer layer of any embodiment of the present invention disclosed herein can have indicia imprinted thereon, thus providing yet another surface for any indicia including, but not limited to, advertising, coupons, sweepstake information, or the like.

Figure 6:
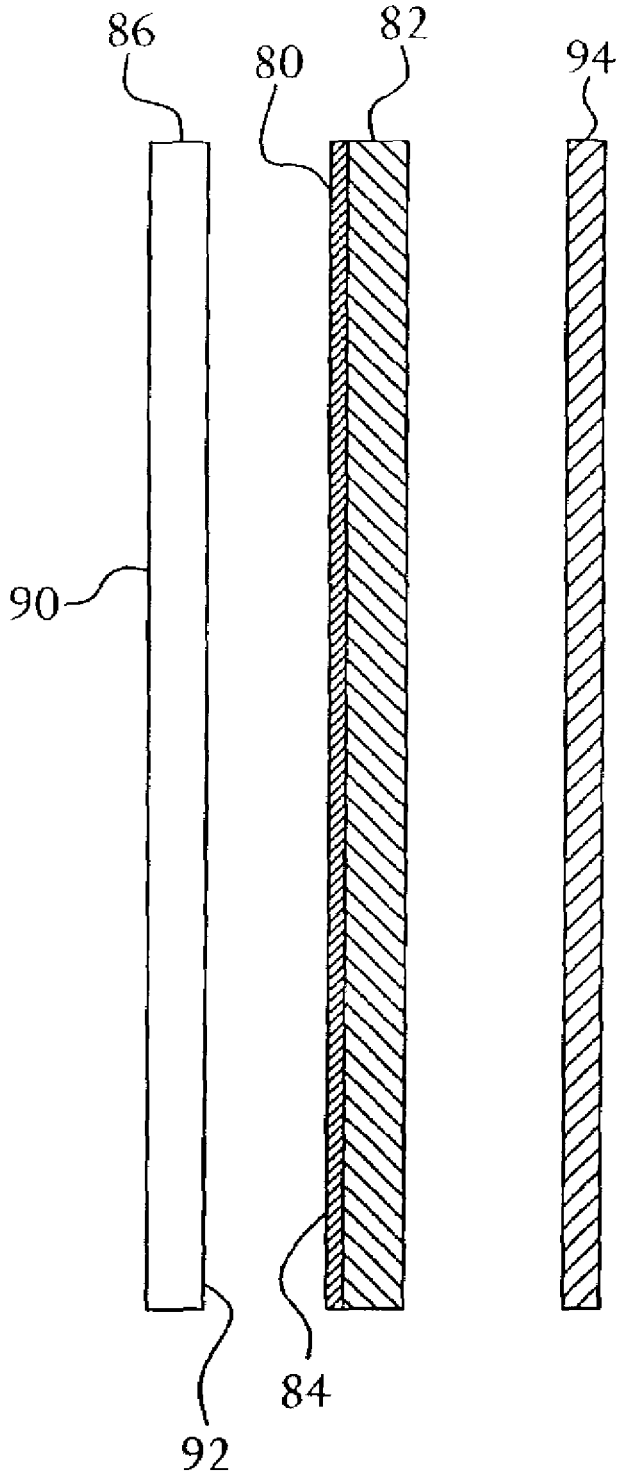
FIG. 6 shows a side view of an alternate embodiment of the present invention having a magnetic layer.

Another embodiment of the present invention is shown in FIG. 6. In this embodiment, the inner side 80 of the pre-approved incentive card 82 has a magnetic layer comprising a magnetic coating 84. The magnetic coating 84 of the inner side 80 can be used to attach the pre-approved incentive card 82 to any metallic surface. In addition, a base layer 86 as described above can be provided on the inner side 80 of the pre-approved incentive card 82. The base layer 86 has an appropriate adhesive on its inner side 90 for attaching to a product package, and a dry-release adhesive on its outer side 92. An outer layer 94, in any of the forms described herein, can be used to cover the pre-approved incentive card 82. It is understood that the embodiment shown in FIG. 6 can have no base layer 86, so that the magnetic coating 84 can be directly attached to a metallic surface.

In addition, the magnetic coating 84 can be separable from the pre-approved incentive card 82, so that the magnetic coating 84 can be removed from the pre-approved incentive card 82 prior to use. The magnetic coating 84 can be imprinted with indicia, so that once the pre-approved incentive card 82 is separated from the magnetic coating 84, the magnetic coating 84 can act as an additional advertising device or coupon for use by a consumer.

FIG. 7 shows another embodiment of the present invention, wherein an advertising item 300 comprises a separable magnetic item 302. The magnetic item 302 provides companies with an additional advertising mechanism, as now described. The magnetic item 302 has an inner side 304 which is magnetic and capable of adhering to a metallic surface. The inner side 304 may further be removably attached to a base layer 317 as described above comprising suitable removable adhesive for removably affixing the embodiment of the label and incentive item shown in FIG. 7 to a product package. For example, the inner side 319 of the base layer 317 can comprise an adhesive for attaching the label and incentive item to a product package, while the outer side 321 of the base layer 317 can comprise an adhesive for removable attachment of the outer side 321 of the base layer 317 to the inner side 304 of the magnetic item 302.

The magnetic item 302 has an outer side 306 which is imprintable. Thus, the outer side 306 can have indicia 312 imprinted thereon, as shown in FIG. 7'. Once the magnetic item 302 is separated from the pre-approved incentive card 310, a consumer or recipient of the embodiment shown in FIGS. 7 and 7' has a permanent item which can be used as a magnet. The indicia 312 can, for example, take the form of advertising, or can be a valuable coupon supplied by a product manufacturer. An adhesive layer 308 is disposed between the outer side 306 of the magnetic item 302 and the pre-approved incentive card 310 for removable attachment of an advertising item to the pre-approved incentive card 310. Although the adhesive layer 308 is shown in FIG. 7 as attached to the outer side 306 of the magnetic item 302, the adhesive layer 308 can alternately be provided on the inner side 314 of the pre-approved incentive card 310. The magnetic item 302 can be flexible, as shown in FIG. 7'.

The pre-approved incentive card 310 and outer layer 316 can be of any of the arrangements disclosed herein, wherein the outer layer 316 is removably attached to the pre-approved incentive card 310. In addition, the outer layer 316 can be formed as an additional magnetic item, such as the magnetic item 302 described. In that case, the outer layer 316 would act both as a cover for the pre-approved incentive card 310, and as a separable magnet.

It is understood that in any embodiment of the present invention, the outer layer can be sized so that at least a portion of the outer layer extends beyond the width or length of the pre-approved incentive card, and forms an edge that can be used to affix the pre-approved incentive card to a product package. In that case, the inner side of the pre-approved incentive card does not have to have a base layer or adhesive thereon, although a base layer or adhesive can be utilized to provide an additional means for attaching the pre-approved incentive card to the product package.

It is also understood that in each embodiment of the present invention, a base layer having an adhesive on its inner side for affixing the label and incentive item of the present invention to a product package, and an outer side having an adhesive for attaching to a pre-approved incentive card, can be utilized.

The present invention may be embodied in other specific forms without departing from the spirit or essential attributes thereof and, accordingly, reference should be made to the appended claims, rather than to the foregoing specification, as indicating the scope of the invention.

What is claimed is:

1. A removable label and incentive item for the collection of consumer survey data, comprising:

a. a base layer, wherein the base layer has an inner side comprising an adhesive for attaching the base layer to one of a product package or release paper and an outer side comprising an adhesive, and;

b. a pre-approved incentive item having an inner side and an outer side, the inner side of the pre-approved incentive item being removably attached to the outer side of the base layer; and c. an outer layer having an inner side and an outer side, the inner side of the outer layer being removably attached to the outer side of the pre-approved incentive item, the outer layer covering at least a portion of the outer side of the pre-approved incentive item, wherein the outer layer is removably attached to the outer side of the pre-approved incentive item via electrostatic attraction.

2. The removable label and incentive item of claim 1, wherein the base layer has an inner side comprising a pressure sensitive adhesive for attaching the base layer to one of a product package or release paper.

3. The removable label and incentive item of claim 1, wherein the adhesive is a dry-release adhesive.

4. The removable label and incentive item of claim 1, wherein the outer side of the pre-approved incentive item has indicia imprinted thereon.

5. The removable label and incentive item of claim 4, wherein the outer layer covers at least a portion of the indicia imprinted on the outer side of the pre-approved incentive item.

6. A removable label and incentive item for the collection of consumer survey data, comprising:

a. a base layer having an inner side and an outer side, wherein the inner side of the base layer comprises an adhesive for attaching the base layer to one of a product package or release paper;

b. a pre-approved incentive item having an inner side and an outer side, the inner side of the pre-approved incentive item being removably attached to the outer side of the base layer; and c. an outer layer having an inner side and an outer side, the inner side of the outer layer being removably attached to the outer side of the pre-approved incentive item, the outer layer covering at least a portion of the outer side of the pre-approved incentive item, wherein the inner side of the outer layer has indicia imprinted thereon and wherein the outer layer is removably attached to the outer side of the pre-approved incentive item via electrostatic attraction.

7. A removable label and incentive item, for the collection of consumer survey data, comprising:

a. a base layer having an inner side and an outer side, wherein the inner side of the base layer comprises an adhesive for attaching the base layer to one of a product package or release paper;

b. a pre-approved incentive item having an inner side and an outer side, the inner side of the pre-approved incentive item being removably attached to the outer side of the base layer; and c. an outer layer having an inner side and an outer side, the inner side of the outer layer being removably attached to the outer side of the pre-approved incentive item, the outer layer covering at least a portion of the outer side of the pre-approved incentive item, wherein the outer layer is removably attached to the outer side of the pre-approved incentive item via electrostatic attraction;

wherein the label and incentive item is attached to a product package having indicia thereon, wherein the outer side of the outer layer reproduces at least a portion of the indicia covered by the label and incentive item.

* * * * *